US006620063B1

(12) United States Patent
Benjamin

(10) Patent No.: US 6,620,063 B1
(45) Date of Patent: Sep. 16, 2003

(54) HOP SCOTCH GAME 2

(76) Inventor: Gregory Benjamin, 333 McKenzie Dr., Stockbridge, GA (US) 30281

( * ) Notice: Subject to any disclaimer, the term of this patent is extended or adjusted under 35 U.S.C. 154(b) by 0 days.

(21) Appl. No.: 10/140,879

(22) Filed: May 9, 2002

Related U.S. Application Data

(60) Provisional application No. 60/289,826, filed on May 10, 2001.

(51) Int. Cl.[7] ..... A63F 3/00
(52) U.S. Cl. ..... 473/414; 273/284; 273/87
(58) Field of Search ..... 273/242, 243, 273/284, 287; 473/414

(56) References Cited

U.S. PATENT DOCUMENTS 3,139,281 A 6/1964 Nicholson
D264,102 S * 4/1982 Howard ..... D21/349
4,733,864 A 3/1988 Casteel
4,946,170 A * 8/1990 Mastro ..... 273/258
5,785,613 A 7/1998 Francis
5,924,940 A 7/1999 Luey, Jr.

* cited by examiner

*Primary Examiner*—Benjamin H. Layno
*Assistant Examiner*—Vishu Mendiratta
(74) *Attorney, Agent, or Firm*—Patent & Trademark Services; Thomas Zack; Joseph H. McGlynn

(57) ABSTRACT

A portable hop scotch game board has a single game board of hop scotch on one side and on the opposite side of the same board a double game of hop scotch is laid out. There are also pockets, used for the scotch throwing piece, attached to the corners and pockets are provided over each numbered block.

6 Claims, 2 Drawing Sheets

HOP SCOTCH GAME 2

Applicant claims the benefit of the U.S. Provisional application No. 60/289,826 filed on May 10, 2001.

BACKGROUND OF THE INVENTION

The present invention relates to a game having a portable game board of hop scotch played on an artificial surface and playing pieces.

The game of hop scotch is very old. It has been played on many types of surfaces including dirt, concrete and asphalt payments, and other artificial surfaces that are generally flat. In playing the game a player throws something that is considered a scotch. The game board has blocks or squares (e.g., 8 to 10) which the player must skip over on one leg unless the square has the scotch in it in which case it must be jumped over the first time approached. Each player tries to sequentially go from a numbered square or block to block until they get to the "turn-around point". After reaching this block, the player turns around freely and starts back to the initial start position with only one foot allowed in each block. The block having the stone laid must also be step in on the return and picked up . Once the player reaches the start point the next player will repeat the cycle. On their next chance, the same player throws the scotch into the block 2 and the player must skip over this block with the scotch. Play continues until all blocks are used. After completion of the game, i.e. all blocks having a stone in them, the first player to complete all block without violating any rules will be declared the winner. After a player has reached the end of the first cycle (all of the blocks) the first block belongs to that player. Players behind cannot step in this first block until they complete the cycle including all of the block (e.g., blocks 1–9). The game continues until all blocks belong to the player in the lead or if jumping to the correct blocks is impossible. After competitors cannot jump or reach over some block (e.g., two adjacent blocks 4 or 5) the game is over.

DESCRIPTION OF THE PRIOR ART

Playing the game of hop scotch on a portable game board is well known to the prior art. For example, U.S. Pat. No. 3,139,281 to Nicholson discloses a folding hop scotch game board which has handles to allow carrying the game board to different locations.

U.S. Pat. No. 4,733,864 to Casteel discloses a hop scotch game board is formed on an indoor\outdoor carpet.

U.S. Pat. No. 5,785,613 to Francis discloses a hop scotch game that has a housing which incorporates flashing illumination and an audio signal generator.

U.S. Pat. No. 5,924,940 to Lucy, Jr. discloses a portable hop scotch game which is laid out on a plastic, vinyl or fabric material.

In the present invention a portable hop scotch game has playing pieces (scotches) and a game board with a single game board on one side and on the opposite side of the same board a double game is laid out. Additionally, pockets used for ballast for the game board are provided for in the corners and pockets are also provided over each numbered block for an optional inset all as will be detailed in the specification that follows hereafter.

SUMMARY OF THE INVENTION

This invention relates to a game having a game board used to play the game of hop scotch with sequentially numbered blocks and one or more throw able playing pieces or scotches.

It is the primary object of the present invention to provide for an improved portable game of hop scotch that may be played by one or more players at the same time.

Another object is to provide for such a game wherein ballast for the game board may be stored in pockets in the game board.

These and other objects and advantages of the present invention will become apparent to readers from a consideration of the ensuing description and the accompanying drawings.

DESCRIPTION OF THE PREFERRED EMBODIMENT

Figure 1:
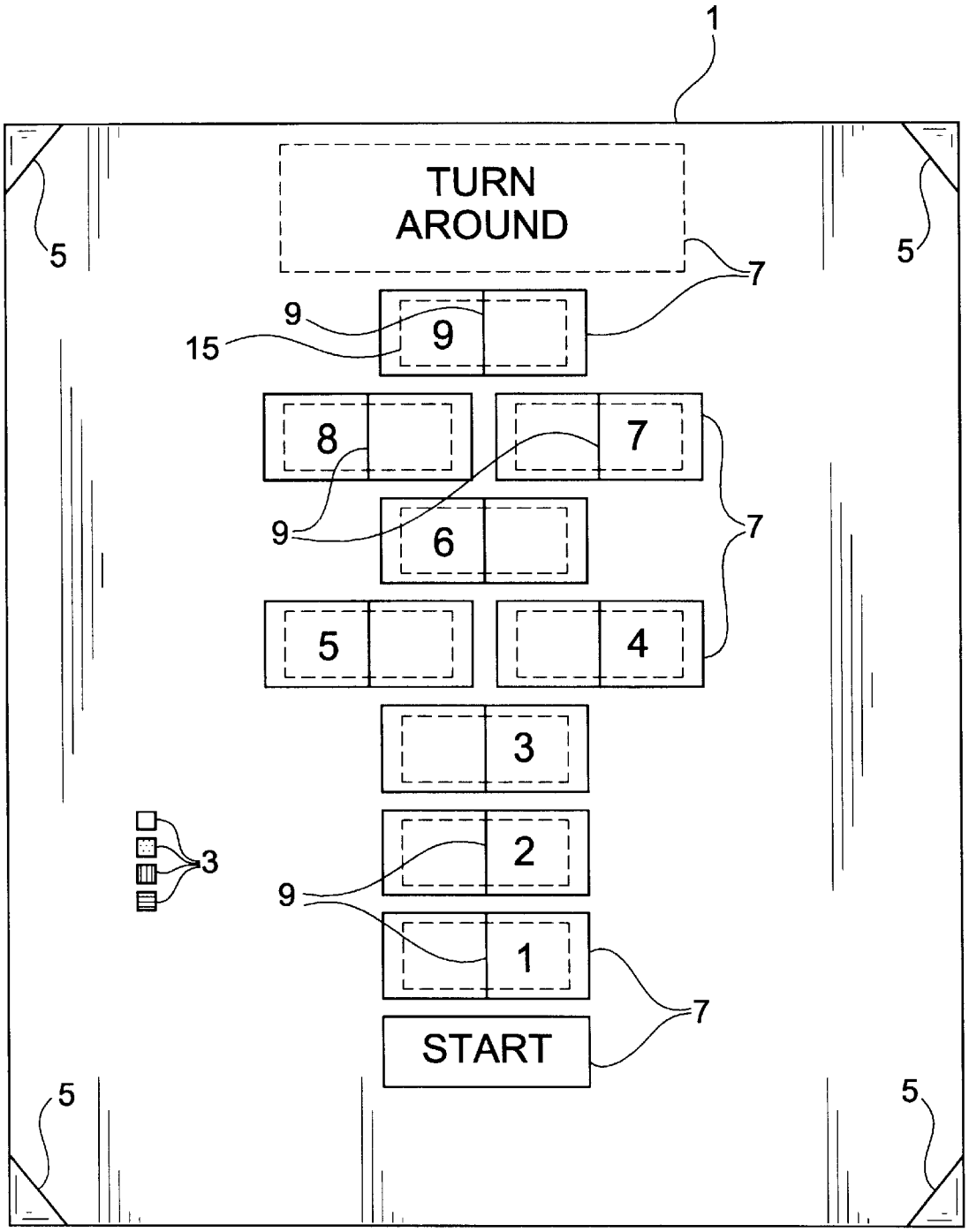
FIG. 1 is a view of the one side of the game board used in the present invention including four scotches used in playing the game.

FIG. 1 is a view of the one side of the game board 1 used in the present invention including four removable scotches or throwing pieces 3 used in playing the game. In the preferred embodiment the pieces 3 were bean bags of four different colors with one used by each player. The game board 1 is rectangular in shape and has a generally flat surface, like a mat or blanket, so that is may be laid upon a similar shaped lower supporting surface such as the ground, a driveway or other flat natural or artificial surface. At each corner of the game board is a three sided pocket 5 opened at one side which is the side facing inwardly. These four pockets may be used to insert ballast materials such as sand or dirt to hold the game board in place on its supporting surface.

The mat game board 1 can be made of GORE-TEX material to provide for a waterproof surface and may be well cushioned. Printed on the exposed surface of the board are blocks 7. The playing blocks have the numbers 1 to 9, inclusive, printed on them while two of the other blocks have the words, start and turn around printed on them. If desired, hop scotch may also be printed on the block with turn around. Each of the playing blocks have an optional slit opening 9 which allows for the insertion of a plastic insert between the overlaid surface of the block and a backing member on the game board. The dotted lines represent the extent of this insert within the playing blocks under the over laid surface. If desired, a flat plastic insert with the number for the particular block could be used as an insert for the block rather than have the number printed on the block. The lower block 7 labeled start is where each player begins the game. The upper block 7 labeled turn around is where the player turns around after traversing the numbered blocks on the board. The players each throw their assigned or picked color coded scotch or bean bag on the numbered spaces sequentially starting at the block numbered one and proceeding to the block nine and then back according to the previously described rules of the game of hop scotch.

Figure 2:
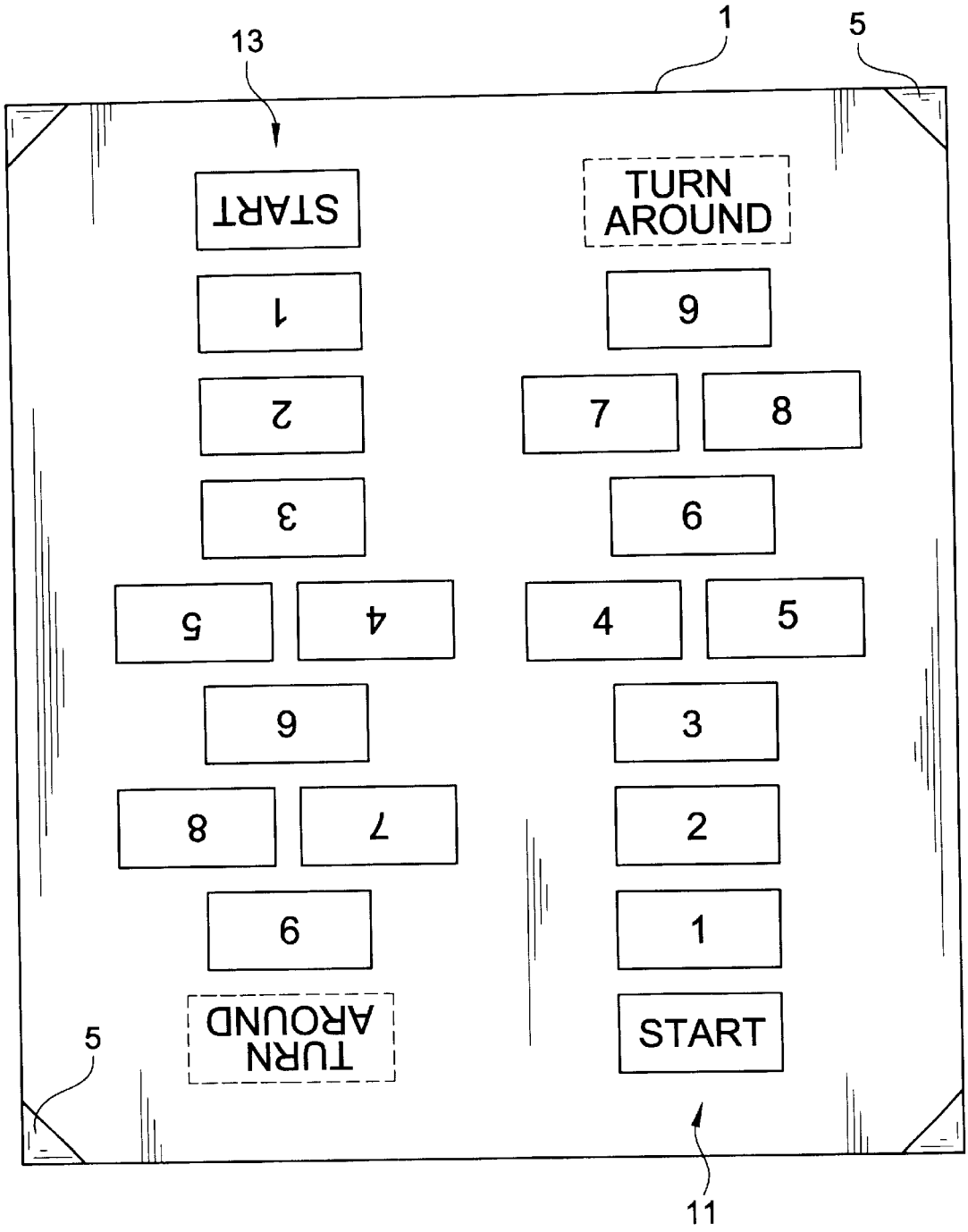
FIG. 2 is a view of the opposite side of the FIG. 1 game board showing two sets of playing blocks.

FIG. 2 is a view of the opposite side of the FIG. 1 game board showing two sets of playing blocks. Each set is similar to the block set shown in FIG. 1 with the same numbering and lettering. Set 11 is reversed from set 13 in that the start position blocks are on opposite sides of the game board as well as the turn around blocks. In each set the numbered blocks start as in FIG. 1 with the number one nearest the start block and the other numbered blocks following in numerical order. Since, the area of the game board is the same on both sides the two sets 11 and 13 have scaled down blocks to accommodate the same game board area surface. One each side of the game board the individual playing pieces are small enough so that one may fit within the confines of the numbered blocks. There are also pockets 5 on this side of the game board to hold ballast materials to retain the game board to its supporting underlying surface, like the ground. Again, the previously mentioned rules of scotch hop apply in playing the game on each of the two sets of blocks. Since, more blocks are available to play in, twice as many players may play in the two at one time than in the single set of blocks shown in FIG. 1. For example, if four players were using the single set of blocks in FIG. 1 with color coded bean bags, then eight players could play on the game board of FIG. 2 at the same time without appreciably extending the total time duration of play. The number of player playing the game at any one time is somewhat arbitrary since one player or more can play on one set of blocks at a time. By having two sets of playing blocks on one side of the game board clearly more players can be accommodated at a given time and they may even compete against each other with one team being assigned to each set of blocks and trying to complete the game in the least time than the players assigned to the other set of blocks.

In the rules of scotch hop players are called out if they touch a line of a numbered block, fall over a line of a block they should touch, throw the scotch out of the correct block, use more than one hand to pick up the thrown scotch, if the scotch is thrown into your next block after a mistake is made, if two feet are used in one block, if they do not pick up the scotch on the run around trip or fail to step in the block with one foot, or if more than one foot is placed in a block at a time.

In one embodiment the mat used for the game board 1 was 8 feet by 6 feet and was 2 inches thick. Either GORE TEX and/or a synthetic rubber was used as material for the mat. The four scotches were bean bags 3 by 3 inches and ¼ of a pound of sand was placed in each corner pocket 5.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A game board and playing pieces for the game of hop scotch comprising:

a game board having on a first side indicia indicating specific different numbered blocks, a start block and a turn around block, said first side of the game board also having pockets into which ballast material may be inserted to retain the game board on a supporting surface, said game board having a second side opposite the first side, said second side having two sets of game board indicia, each of said two sets having the same blocks with the same different numbered blocks as the blocks on the first side, a start block and an opposite side turn around block, and playing pieces that can be thrown on the different numbered blocks of the game board with each playing piece for a given side of the game board being able to fit within a single numbered block on the side of the game board on which each playing piece is used.

2. The game board and playing pieces as claimed in claim 1, wherein said game board has four corners with one of the pockets on the first side of the game board located at each of the four corners.

3. The game board and playing pieces as claimed in claim 2, wherein said second side of the game board has pockets into which ballast material may be inserted to retain the game board on a supporting surface.

4. The game board and playing pieces as claimed in claim 3, wherein each of the numbered blocks on the first side of the game board have slits which permit the insertion of a numbered insert for that block.

5. The game board and playing pieces as claimed in claim 4, wherein the playing pieces are bean bags that are color coded to distinguish each from the other.

6. The game board and playing pieces as claimed in claim 5, wherein the game board is made of a flexible waterproof material.

* * * * *